US005893420A

United States Patent [19]

Schoeps

[11] Patent Number: 5,893,420

[45] Date of Patent: Apr. 13, 1999

[54] MULTI-CORE CABLE CONNECTOR FOR POWER WRENCH

[75] Inventor: Knut Christian Schoeps, Tyresö, Sweden

[73] Assignee: Atlas Copco Tools AB, Nacka, Sweden

[21] Appl. No.: 08/971,610

[22] Filed: Nov. 17, 1997

[30] Foreign Application Priority Data

Nov. 19, 1996 [SE] Sweden ..... 9604231

[51] Int. Cl.[6] ..... B25B 21/00

[52] U.S. Cl. ..... 173/181; 173/171; 173/180; 173/182; 173/183; 173/170

[58] Field of Search ..... 173/171, 217, 173/182, 181, 180, 183, 176, 170; 73/862.21, 862.23, 862.331, 467

[56] References Cited

U.S. PATENT DOCUMENTS

| | | | |
|---|---|---|---|
| 3,858,444 | 1/1975 | Wallace | 73/139 |
| 4,066,133 | 1/1978 | Voss | 173/182 |
| 4,273,198 | 6/1981 | Doniwa | 173/182 |
| 4,404,799 | 9/1983 | Dudek | 60/730 |
| 4,485,682 | 12/1984 | Stroezel | 73/862.36 |
| 4,544,039 | 10/1985 | Crane | 173/182 |
| 4,648,282 | 3/1987 | Alender | 173/183 |
| 5,014,793 | 5/1991 | Germanton | 173/181 |
| 5,014,794 | 5/1991 | Hansson | 173/181 |
| 5,180,019 | 1/1993 | Thiry | 173/168 |
| 5,181,575 | 1/1993 | Maruyama et al. | 173/188 |
| 5,563,482 | 10/1996 | Shaw | 173/176 |

FOREIGN PATENT DOCUMENTS

| | | |
|---|---|---|
| 0 092 736 A1 | 11/1983 | European Pat. Off. . |
| 0 293 706 A1 | 12/1988 | European Pat. Off. . |
| 42 10 201 A1 | 9/1993 | Germany . |
| 43 29 199 A1 | 3/1995 | Germany . |

*Primary Examiner*—Scott A. Smith
*Assistant Examiner*—James P. Calve
*Attorney, Agent, or Firm*—Frishauf, Holtz, Goodman, Langer & Chick

[57] ABSTRACT

A cable connector for assembly and mounting on a front section of a housing of a power wrench is arranged to connect at least one operation parameter sensor of the power tool to a multi-core cable. The cable connector includes a multi-contact cable connector plug carried on the multi-core cable, and a one-piece mounting member which is made of an elastically resilient material and which is secured to the front section of the housing and supports a multi-contact jack. The multi-contact cable connector plug includes a coupling sleeve formed with an internal thread, and the mounting member includes an open ring portion to be mounted around the front section of the housing and a tubular coupling portion extending laterally from the ring portion. The tubular coupling portion is divided along an axial plane into two halves, which together forming: (i) an internal socket for receiving and retaining the multi-contact jack, and (ii) an external thread for co-operating with the internal thread of the coupling sleeve upon interconnection of the cable connector plug and the mounting member. The ring portion and the tubular coupling portion halves are elastically expandable to facilitate assembly of the cable connector.

12 Claims, 3 Drawing Sheets

MULTI-CORE CABLE CONNECTOR FOR POWER WRENCH

The invention relates to a power wrench provided with a sensor for producing electric signals in response to the instantaneous value or values of one or more parameters such as torque and angle of rotation which are significant in a tightening process to be performed by the wrench.

In particular, the invention concerns a power wrench having a torque and/or rotation angle sensor and signal generator associated with the output spindle of the wrench, and a connector means for a multi core cable carried on the wrench housing. The connector includes both a connection member secured on the housing and supporting a multi contact jack which communicates with the sensor and signal generator, and a multi contact cable connector plug.

BACKGROUND OF THE INVENTION

A power wrench of this type has been disclosed in U.S. Pat. No. 5,181,575. In this prior art wrench a torque transducer is connected to a remotely located signal processing unit by means of an electric conductor leaving the wrench through the pistol handle. This means that the electric conductor is routed through the wrench housing and, accordingly, the wrench housing has to be designed to provide space for the conductor.

In order to avoid having to specially design the wrench housing so as to enable an internal routing of the signal conducting cables, there may be used an external cable connection mounted directly on the transducer part of the wrench housing. The problems to be solved in such a case are how to prevent the wrench from increasing in weight and size and how to protect the connector from mechanical damage.

OBJECTS OF THE INVENTION

The primary object of the invention is to accomplish a light, compact, uncomplicated and rugged cable connection which is easily mounted on the wrench housing and which provides a well protected multi contact connection between the cable and a tightening parameter sensor such as, for a torque transducer and/or a rotation angle encoder.

A further object of the invention is to provide a power wrench with a torque transducer and a cable connector, wherein the cable connector enables a light signal to be delivered to inform an the operator of certain operational conditions of the power wrench.

A preferred embodiment of the invention is hereinbelow described in detail with reference to the accompanying drawings.

DETAILED DESCRIPTION

Figure 1:
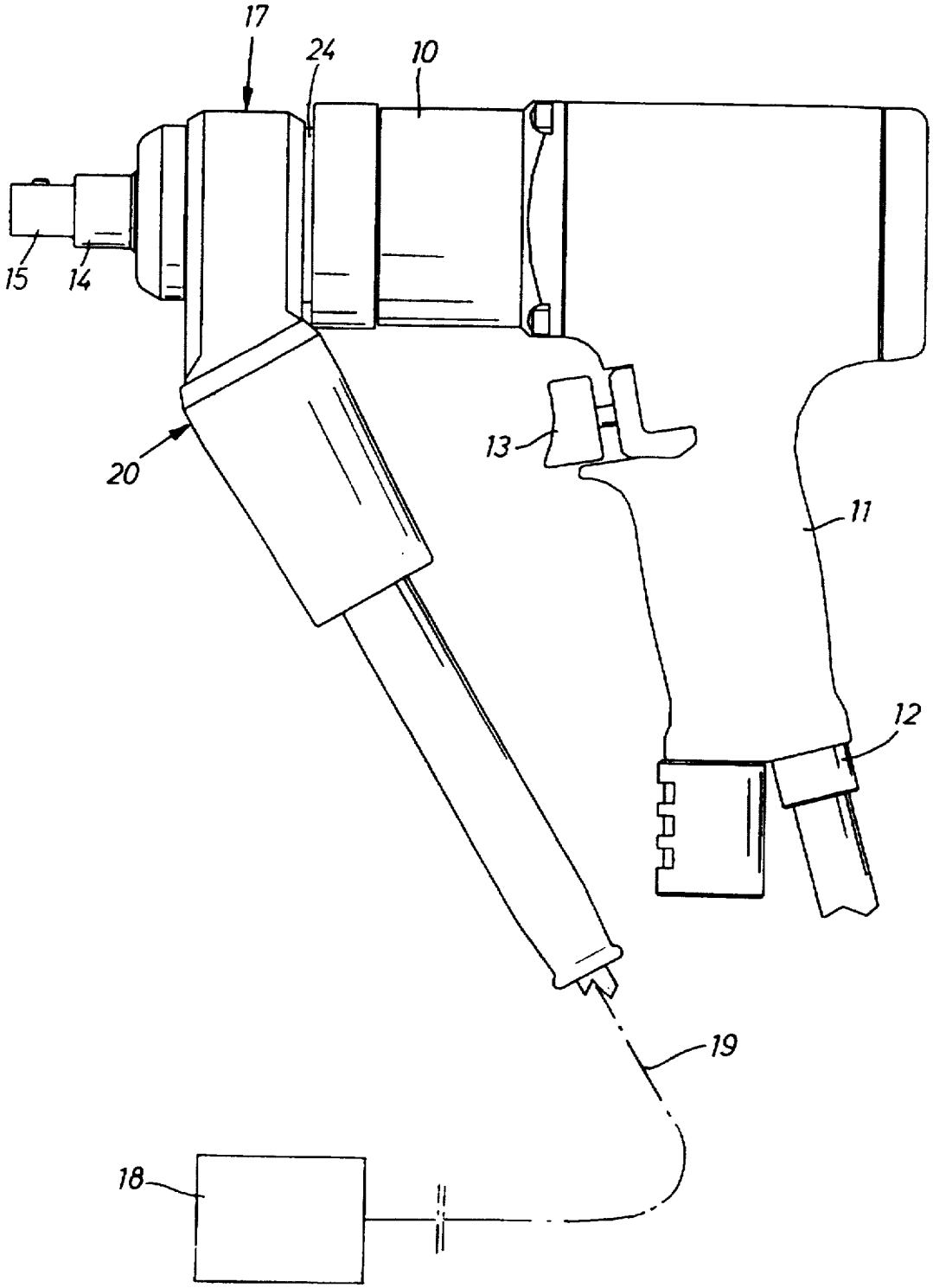
FIG. 1 shows a side view of a power wrench according to the invention.

The power wrench shown in FIG. 1 is a pistol type impulse wrench comprising a housing 10 with a handle 11, a rotation motor and a hydraulic impulse generator (not shown) located in the housing 10. The power wrench further comprises a power supply connection 12 communicating with the motor, a power controller maneuvered by a trigger button 13, and an output spindle 14 connected directly to the impulse generator and provided with a square end 15 for carrying a nut socket.

Associated with the output spindle 14, the wrench is provided with a torque transducer 17 for producing electric signals in response to the magnitude of the pulsating torque delivered by the output spindle 14. The torque transducer is connected to a process controlling and monitoring unit 18 via a multi core cable 19. The latter is connected to the wrench by means of a cable connector 20.

Figure 2:
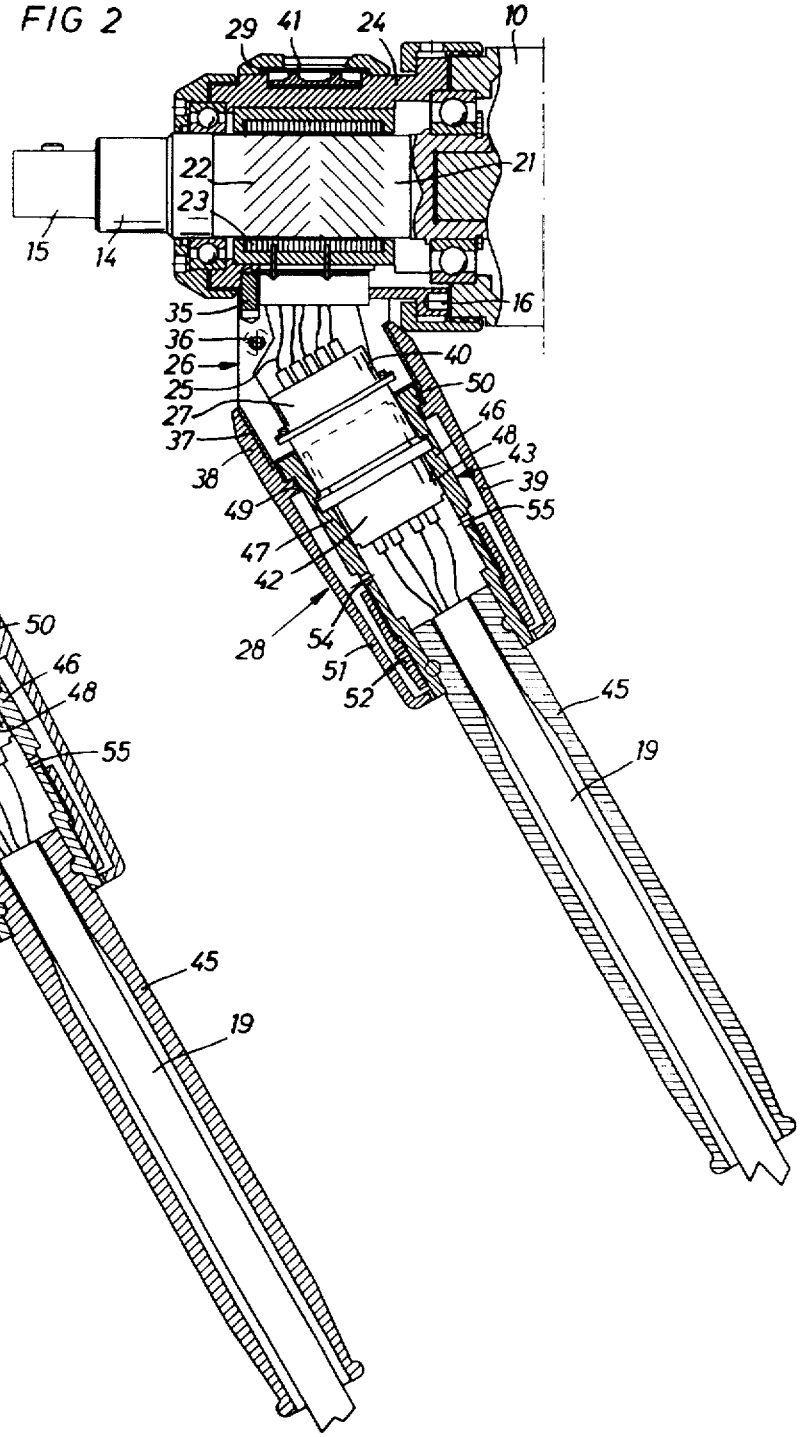
FIG. 2 shows, on a larger scale and partly in section, the front part of the power wrench in FIG. 1.

As shown in FIG. 2, the torque transducer 17 is of a contact free type including an output spindle portion 21 of a magnetostrictive material provided with groups of inclined surface grooves 22 arranged in a certain pattern, and exiting coils 23 disposed around this spindle portion 21. The exiting coils 23 are connected to the control and monitoring unit 18 via the connector 20 and the cable 19.

The transducer 17 is of a previously well known type which is described in for instance the above mentioned U.S. Pat. No. 5,181,575 as a part of a power wrench or in general in U.S. Pat. No. 4,933,580. The torque transducer and is, therefore, not described in further detail.

The housing 10 is provided with a tubular front section 24 which is rigidly secured to the housing 10 and which forms on its inside a support for the exiting coils 23. On its outside, the front section 24 forms a support for the cable connector 20. On the outside of the front section 24, there are also mounted a number of electronic components for treating the signals delivered by the transducer 17 and for emitting light signals in response to the delivered signals corresponding to predetermined target values or not. These electronic components are not shown explicitly since they can be arranged in several alternative ways and do not by themselves form a part of the invention.

The housing section 24 is clamped to the housing 10 and rotationally locked thereto by means of a lock pin 16. See FIG. 2. The housing section 24 is provided with a number of circumferentially spaced holes (not shown) for alternative engagement with the lock pin 16, which means that the housing section 24 may be secured to the housing 10 in a number of different angular positions.

The cable connector 20 comprises a connection member 26 for mounting on the housing front section 24, a multi contact jack 27 and a multi contact cable connector plug 28. The jack 27 is connected to the electronic components via a wiring 25.

Figure 4:
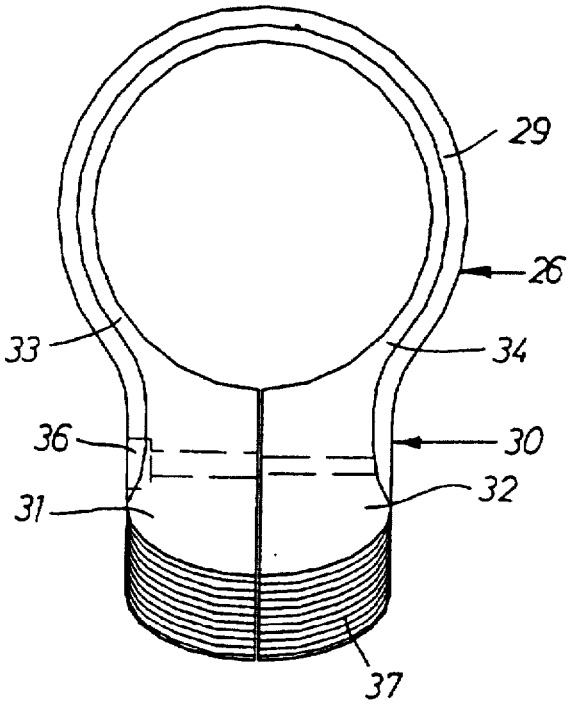
FIG. 4 shows a front end view of the connection member occupying its normal closed position.

The connection member 26 is made of an electrically insulating and elastically resilient material like plastic and comprises an open ring element 29 and a coupling portion 30. The latter is divided along an axial plane into two halves 31, 32, and the ring element 29 has two end portions 33, 34 each carrying one of the coupling portion halves 31, 32. See FIGS. 4 and 5.

When mounted on the housing front portion 24, the connection member 26 is rotationally locked thereto by a radial lock pin 35. Accordingly, the connection member 26 is positively locked in a predetermined angular positions relative to the housing section 24. In order to retain properly the multi contact jack 27 within the socket 40 before the coupling sleeve 39 is threadedly engaged with the coupling portion 30, the two halves 31,32 of the latter are clamped together by a transverse screw 36.

On its outside, the coupling portion 30 is formed with a thread 37 for engagement with an internally threaded portion 38 of a coupling sleeve 39 of the cable connector plug 28. On its inside, the coupling portion 30 is formed with a socket means 40 for receiving and retaining the multi contact jack 27.

For making the light emitting electronic components visible from outside, the ring element 29 is provided with one or more radial through openings or windows 41. As an alternative to these openings 41, the ring element 29 may made of a light penetrating material, for instance an unpigmented plastic.

Figure 3:
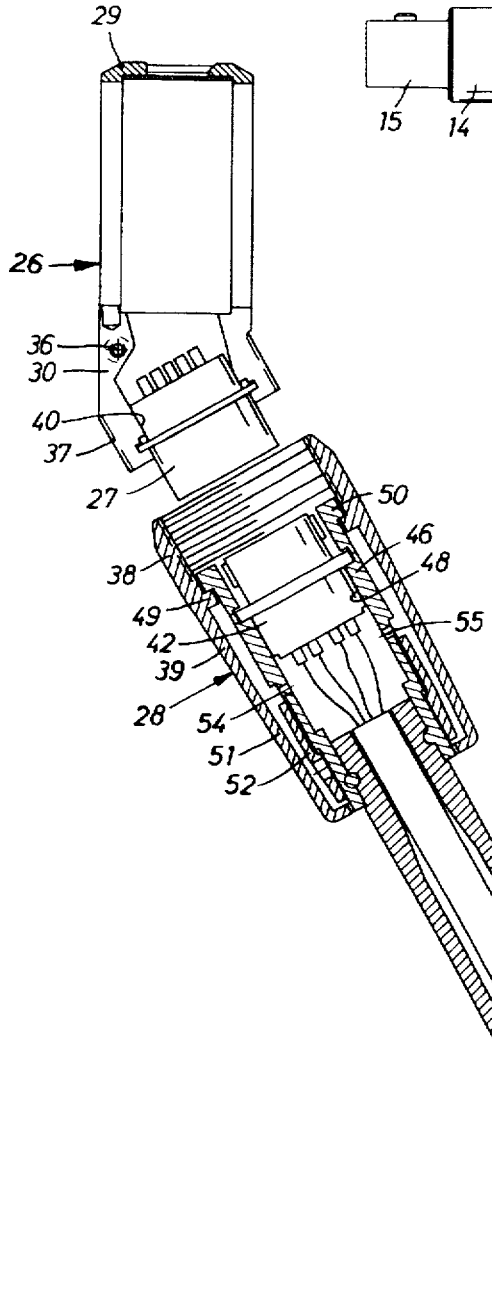
FIG. 3 shows parts of the cable connection in a disconnected condition.

In FIG. 3, the connection member 26 is shown separated from the cable connector plug 28 as well as from the wrench housing.

For illustration purposes, the connection member 26 still supports the jack 27, although the latter is disconnected from the wiring 25 and the electronic components carried on the housing section 24.

Apart from the coupling sleeve 39, the cable connector plug 28 comprises a multi contact unit 42 for engagement with the multi contact jack 27 and a mounting sleeve 43 for retaining the contact unit 42. The mounting sleeve 43 consists of two semitubular shells 46,47 which together form an internal socket 48 for supporting the contact unit 42. The shells 46,47 also form together an external annular shoulder 50 to be engaged by an internal shoulder 49 in the coupling sleeve 39 for accomplishing an axial clamping force between the connector plug 28 and the connection member 26. The shells 46, 47 are kept together by a retaining sleeve 52.

Moreover, the coupling sleeve 39 is formed with a tubular skirt portion 51 which extends rearwardly from the threaded portion 38 and the internal shoulder 49 to form a protective cover around the contact unit 42 and the closest part of the cable 19. This end part of the cable 19 is also covered by a resilient tubing 45 for protecting the cable 19 against mechanical wear.

Figure 5:
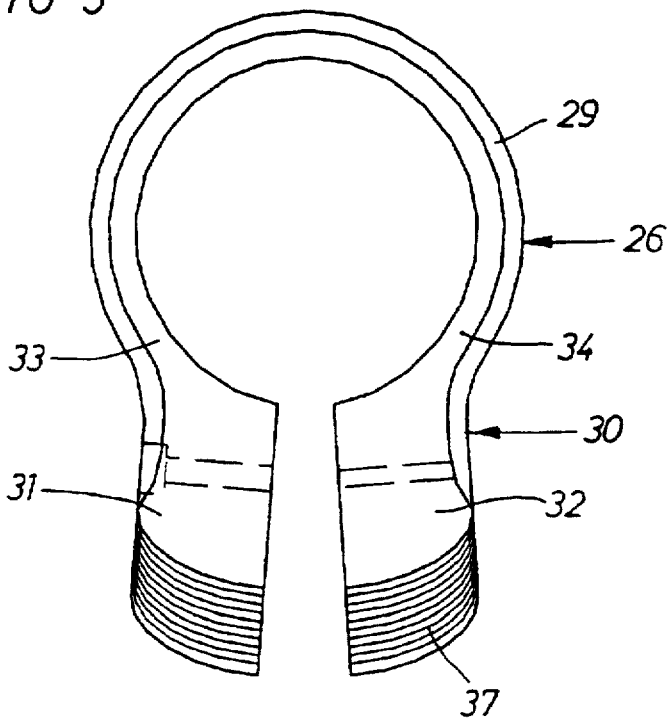
FIG. 5 shows the same view as FIG.4, but illustrates the connection member in its open mounting position.

For mounting the connection member 26 on the front housing section 24, the connection member 26 has to be "opened", i.e. the two connection portion halves have to be elastically bent apart as illustrated in FIG. 5. The reason for that is to accomplish an easier mounting on the housing. The most important reason, however, is to be able to premount the coils with the electronic components and the wiring 25 on the housing portion 24 together with the contact jack 27 before the connection member 26 is fitted, because it would be very difficult to connect the wiring 25 to the multi contact jack 27, for instance by soldering, after mounting of the connection member 26 on the housing section 24.

As the connection member 26 is properly mounted on the housing it is rotationally locked in a desired angular position by the radial pin 35, and the coupling portion halves 31,32 are clamped together by transverse screw 36.

The cable connector plug 28 is assembled firstly by connecting, for instance by soldering, the cores of the cable 19 to the contact unit 42 and then by fixing the contact unit 42 between the two shells 46,47 forming the mounting sleeve 43 and introducing this assembly into the coupling sleeve 39. As the internal shoulder 49 on the coupling sleeve 39 engages the external shoulder 50 on the mounting sleeve 43 an axial locking of the contact unit 42 is obtained. Putting together the contact unit 42 and the multi contact jack 27 and having the coupling sleeve 39 engage the thread 37 on the connection member 26 and to be tightened thereon, the cable connection is completed.

For protecting the cores of the cable 19 from being exposed to tension strain, the cable 19 comprises a nonconductive tension cord (not shown), which is secured to the mounting sleeve 43 via radial openings 54,55 in the shells 46,47.

Again, it is to be noted that the invention is not limited to a power wrench having just a torque transducer as in the above described example. The power wrench according to the invention may very well also comprise a rotation sensor in the form of a rotation angle encoder associated with the output spindle. Also such a rotation angle sensor may generate electric signals which are communicated to the process controlling and monitoring unit via the multi core cable and the multi contact cable connection.

Accordingly, signals representing parameters which are significant in the screw joint tightening process are communicated from the power wrench to a remotely located control and monitoring unit via a multi core cable which is connected to the wrench by means of a multi contact cable connection, as recited in the appended claims.

I claim:

1. A cable connector for a power wrench, wherein said power wrench comprises a housing having a cylindrical front section, a motor, an output spindle coupled to said motor, and at least one operation parameter sensor associated with said output spindle, and wherein said cable connector is carried on said front section of said housing and is arranged to connect said at least one operation parameter sensor to a multi-core cable, said cable connector comprising:

a multi-contact cable connector plug carried on said multi-core cable, said multi-contact cable connector plug including a coupling sleeve formed with an internal thread; and a one-piece mounting member secured to said front section of said housing and supporting a multi-contact jack, said mounting member being made of an elastically resilient material and comprising an open ring portion to be mounted around said front section of said housing and a tubular coupling portion extending laterally from said ring portion;

wherein said tubular coupling portion is divided along an axial plane into two halves, said two halves together forming: (i) an internal socket for receiving and retaining said multi-contact jack, and (ii) an external thread for co-operating with said internal thread of said coupling sleeve upon interconnection of said cable connector plug and said mounting member; and wherein said ring portion and said tubular coupling portion halves are elastically expandable to facilitate assembly of the cable connector.

2. The cable connector according to claim 1, wherein said coupling sleeve comprises:

an internal shoulder forming an axial support for said connector plug; and a tubular skirt portion extending in a direction of said multi-core cable and mechanically protecting said connector plug and an end part of said multi-core cable.

3. The cable connector according to claim 2, wherein said connector plug comprises:

a multi-contact unit which is electrically connected to core portions of said multi-core cable; and a mounting sleeve which is mechanically connected to said multi-core cable;

wherein said mounting sleeve comprises two semi-tubular shells which together form an internal socket for retaining said multi-contact unit, and an external shoulder for positive engagement with said internal shoulder of said coupling sleeve.

4. The cable connector according to claim 3, wherein said housing of said power tool includes a pistol-shaped handle, said mounting member is secured at a predetermined angular position relative to said front section of said housing, and said front section is affixable to said housing in a number of alternative angular positions for enabling alternative cable connection directions relative to a direction of said pistol handle.

5. The cable connector according to claim 2, wherein said power tool includes electronic signal treating components provided on an outside portion of said front section of said housing, and said ring portion of the mounting member forms a protective cover for said electronic signal treating components.

6. The cable connector according to claim 5, wherein said electronic signal treating components comprise one or more light emitting devices, and said ring portion is provided with one or more radial through openings which enable said light emitting devices to be visible from outside said ring portion.

7. The cable connector according to claim 6, wherein said housing of said power tool includes a pistol-shaped handle, said mounting member is secured at a predetermined angular position relative to said front section of said housing, and said front section is affixable to said housing in a number of alternative angular positions for enabling alternative cable connection directions relative to a direction of said pistol handle.

8. The cable connector according to claim 5, wherein said electronic components comprise one or more light emitting devices, and said ring portion comprises a light penetrating material through which said light emitting devices are visible from outside said ring portion.

9. The cable connector according to claim 8, wherein said housing of said power tool includes a pistol-shaped handle, said mounting member is secured at a predetermined angular position relative to said front section of said housing, and said front section is affixable to said housing in a number of alternative angular positions for enabling alternative cable connection directions relative to a direction of said pistol handle.

10. The cable connector according to claim 5, wherein said housing of said power tool includes a pistol-shaped handle, said mounting member is secured at a predetermined angular position relative to said front section of said housing, and said front section is affixable to said housing in a number of alternative angular positions for enabling alternative cable connection directions relative to a direction of said pistol handle.

11. The cable connector according to claim 2, wherein said housing of said power tool includes a pistol-shaped handle, said mounting member is secured at a predetermined angular position relative to said front section of said housing, and said front section is affixable to said housing in a number of alternative angular positions for enabling alternative cable connection directions relative to a direction of said pistol handle.

12. The cable connector according to claim 1, wherein said housing of said power tool includes a pistol-shaped handle, said mounting member is secured at a predetermined angular position relative to said front section of said housing, and said front section is affixable to said housing in a number of alternative angular positions for enabling alternative cable connection directions relative to a direction of said pistol handle.

* * * * *